United States Patent [19]

Podolsky et al.

[11] 4,053,745

[45] Oct. 11, 1977

[54] VALVE CONTINGENCY DETECTION SYSTEM FOR A TURBINE POWER PLANT

[75] Inventors: Leaman B. Podolsky, Wilmington, Del.; Charles L. Groves, Jr., Wexford, Pa.

[73] Assignee: Westinghouse Electric Corporation, Pittsburgh, Pa.

[21] Appl. No.: 631,299

[22] Filed: Nov. 12, 1975

[51] Int. Cl.[2] ..... F01B 25/00

[52] U.S. Cl. ..... 364/494; 415/17; 60/39.24; 364/300

[58] Field of Search ..... 235/151.21, 151, 151.34; 444/1; 60/39.24, 39.28 R, 73, 105; 415/1, 13, 15, 17; 290/2, 40, 40.2

[56] References Cited

U.S. PATENT DOCUMENTS

| | | | |
|---|---|---|---|
| 3,552,872 | 1/1971 | Giras et al. | 415/17 |
| 3,555,251 | 1/1971 | Shavit | 235/151 |
| 3,561,216 | 2/1971 | Moore, Jr. | 60/73 |
| 3,564,273 | 2/1971 | Cockrell | 290/40 R |
| 3,588,265 | 6/1971 | Berry | 415/1 |

*Primary Examiner*—Edward J. Wise
*Attorney, Agent, or Firm*—H. W. Patterson

[57] ABSTRACT

A system for detecting the failure of steam inlet valves to respond properly to their respective control signals, is disclosed. The detection of such a contingency provides an appropriate indication, and also initiates a transfer to single valve operation when operating in the sequential valve mode. The system provides for indicating and/or transferring to single valve operations only after the contingency has been detected for a predetermined interval to compensate for the velocity limiting characteristics of the valve actuators.

11 Claims, 7 Drawing Figures

VALVE CONTINGENCY DETECTION SYSTEM FOR A TURBINE POWER PLANT

BACKGROUND OF THE INVENTION

In the operation of electric power plants, steam turbines typically have multiple throttle valves andor governor valves to control the flow of steam to the turbine. The throttle valves, when provided, are utilized in starting up the turbine until it reaches approximately eighty-percent of synchronous speed, at which point control is transferred to the governor valves. In nuclear installations, the steam turbines are controlled solely by governor valves. Once the governer valves are controlling the admission of steam to the turbine, they may be controlled in the full arc or single valve mode of operation; i.e., where all the valves are operated to admit the same portion of the total steam flow through a full arc of nozzles; or they may be operated in the partial arc or sequential mode, where the steam is admitted through a partial arc by the operation of the valves in a predetermined sequence; i.e., only one or a single group of valves operate to control any variation in total steam flow to the turbine. The valves are operated usually in the single valve mode to heat up the turbine parts uniformly, and are operated in the sequential valve mode to minimize throttling losses due to plurality of partially open valves and to more precisely control steam flow variations. In the event that one or more of the valves that control steam flow in the sequential mode should fail to respond properly to its control signal, the turbine consequently fails to respond to the proper speed, or load command. Further, the failure of a valve to respond in the sequential mode may cause the turbine to suffer what is known as "double shock," which occurs when there is discontinuity of steam admission through adjacent nozzle arcs. In other words, on arc of nozzles is admitting steam, the adjacent arc is admitting little or no steam, and the next adjacent arc is admitting steam. In such event, the turbine should be transferred from sequential valve operation to single valve operation in order to prevent damage to the turbine blades.

U.S. pat. application Ser. No. 404,057, entitled "System and Method for Operating a Steam Turbine with Protection Provisions for Valve Positioning Contingency," filed by Braytenbah and Podolsky on Oct. 5, 1973, and assigned to the common assignee discloses a digital computer controlled turbine power plant control system that includes a system for detecting the failure of a throttle or governor valve to respond to its respective control signal. In accordance with the teaching of such disclosure, the turbine control system includes a speed/-load control function for generating desired valve position signals. It also includes provisions for generating signals which were representative of the actual valve positions. Each one of the actual valve position signals is compared with its respective desired valve position signal, and a contingency condition is detected to provide a suitable indication in the event the actual valve position does not agree with its desired valve position signal.

This system proved reliable in performing its required function. However, in certain circumstances, where a fast action of the valves is effected, particularly where a large change in valve position is required, a valve contingency would be detected while the position of the valve caught up with its control signal. Although this situation did not affect the reliability of the system in detecting an actual contingency, it necessitated precise adjustment of tolerances to prevent the detection of contingencies which could be considered as normal operation. In order to overcome the above condition, it was further proposed to provide a system where the relationship of the positioning or control signal and the actual valve position is compared to a given reference. Such a system, however, was unable to detect all conditions of failure.

In view of the above, it is desirable to provide a system having the reliability of the contingency system described in the copending application Ser. No. 404,057, yet does not detect any normal mismatch of the actual valve position and the valve positioning signal. Such a system then could provide for automatic transfer from sequential to single valve operation without inadvertent transfers occasioned by the described circumstances or lack of proper precise adjustment.

SUMMARY OF THE INVENTION

The present invention broadly relates to a steam turbine system having a plurality of steam inlet valves for admitting steam through nozzles arcuately spaced about the periphery of the steam turbine. A control system generates for each of the valves, a valve positioning control signal to control the admission of steam through either a full or partial arc of nozzles. Each of the valve systems include means for generating a signal corresponding to the actual position of each valve. The actual position signal for each valve is compared with its respective valve positioning control signal at closely spaced time intervals. The failure of any one or all of the valves to respond properly to its control signal is detected in response to each comparison mismatch; i.e., if the comparison is without a predetermined deadband. A contingency output is generated for each valve a predetermined delayed time interval subsequent to its detected mismatch provided that such mismatch persists at the termination of such interval.

In one specific aspect, the turbine control system is structured in a digital computer, which in automatic control calculates a digital control signal for positioning the valves. The actual valve position signal is an analog signal that is converted to a digital signal by an analog input. The system checks the digital position and digital control signal for each valve sequentially. A proper response to the control signal during each checking initiates the beginning of the delayed interval for a respective valve. An improper response advances the interval during each checking of the signals until a contingency output occurs. The system is automatically transferred from partial arc to full arc operation in response to a contingency detection of any one of the valves.

DESCRIPTION OF THE PREFERRED EMBODIMENT

Figure 1:
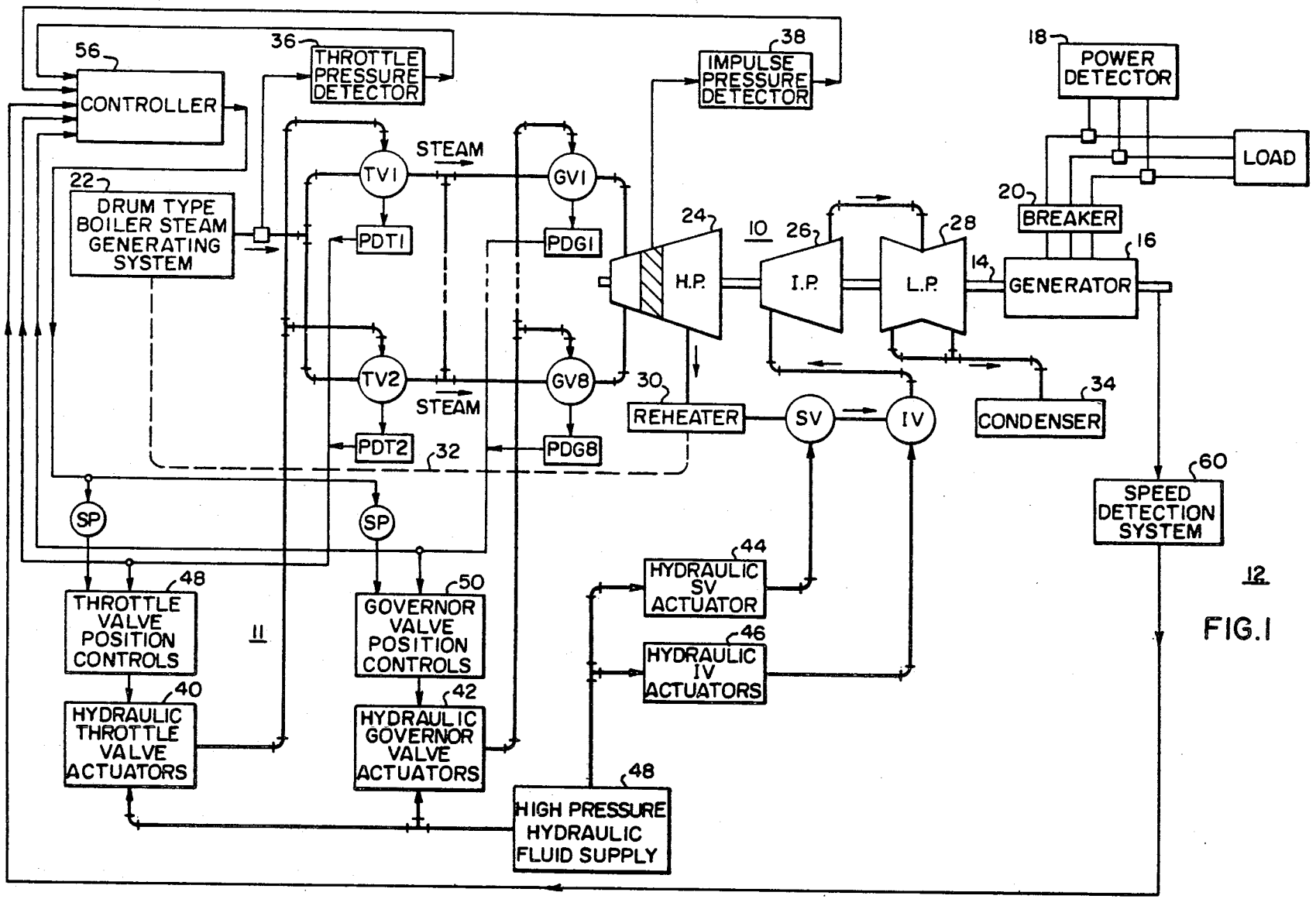
FIG. 1 shows a schematic diagram of a turbine power plant with which the present invention may be utilized.

Referring to FIG. 1, a large single reheat steam turbine 10 is constructed in a well-known manner and operated by a control system 11 in a fossil electric power plant 12 in accordance with the principles of the invention. As will become more evident through this description, other types of steam turbines and electric power plants may also be operated in accordance with the principles of the invention. The turbine 10 and its control system 11 and the electric power plant 12 are similar to those disclosed in a copending patent application Ser. No. 408,962, which is a continuation of Ser. No. 247,877, now abandoned, which is a continuation-in-part of Ser. No. 247,440, now abandoned, which is a continuation-in-part of Ser. No. 246,900, now abandoned, and all relating to the general system and method for starting, synchronizing and operating a steam turbine with digital computer control, all filed by Theodore C. Giras and Robert Uram and assigned to the present assignee, said original application being filed on Apr. 24, 1972.

The turbine 10 is provided with a single output shaft 14 which drives a conventional large alternating current generator 16 to produce three-phase electric power sensed by a power detector 18. Typically, the generator 16 is connected through one or more circuit breakers 20 per phase to a large electric power network; and when so connected causes the turbo-generator arrangement to operate at synchronous speed under steady state conditions. Under transient electric load change conditions, system frequency may be affected and conforming turbo-generator speed changes would necessarily result.

After synchronism, power contribution of the generator 16 to the network is normally determined by the turbine steam flow which in this instance is supplied to the turbine 10 at substantially constant throttle pressure. The steam for driving the turbine 10 is developed by a steam generating system 22 which may, for example, be provided in the form of a conventional drum or once through type boiler operated by fossil fuel. In the present embodiment, the tubine 10 is of the multi-state axial flow type; and it includes a high pressure section 24, an intermediate pressure section 26, and a low pressure section 28. In the present example, steam flow is directed to the turbine steam chests (not shown) through four main inlet or throttle valves TV1 through TV4. Steam is directed from the admission steam chests to the first high pressure section through 8 governor valves GV1 through GV8, which are arranged to supply steam to inlets or nozzles arcuately spaced about the turbine high pressure casing. For nuclear turbines, only four governor valves are typically used. Generally, various turbine inlet valve configurations may involve different numbers and/or arrangements of inlet valves.

In applications where the throttle valves TV1 through TV4 have a flow control capability, the governor valves GV1 through GV8 are typically all fully open during all or part of the start-up process and steam flow is then varied by full arc throttle valve control. At some point in the start-up and loading process, transfer is normally and preferably automatically made from full arc throttle valve control to full arc governor valve control because of throttle energy losses and/or reduced throttling control capability. Upon transfer, the throttle valves TV1 through TV4 are fully open, and the governor valves GV1 through GV8 are positioned to produce the steam flow existing at transfer. After sufficient turbine heating has occurred, the system preferably automatically transfers from full arc governor valve control to partial governor valve control to obtain improved heating rates.

In the partial arc mode, the governor valves are operated in a predetermined sequence usually directed to achieving thermal balance on the rotor and relatively reduced rotor blade stressing while producing the desired turbine speed and/or load operating level. For example, in a typical governor valve control mode, governor valves GV5 through GV8 may be initially closed as the governor valves GV1 through GV4 are jointly operated from time to time to define positions producing the desired total steam flow. After the governor valves GV1 through GV4 have reached the end of their control region; that is, upon being fully open, or at some overlap opening prior to reaching fully open positions, the governor valves GV5 through GV8 are sequentially placed in operation in numerical order to produce continued steam flow control at higher steam flow levels.

In a typical nuclear turbine installation where the main steam inlet valves are stop valves without flow control capability, initial steam flow control is achieved during start-up by means of a single valve mode of governor valve operation. Transfer can then be made to sequential governor valve operation at an appropriate level. Similarly, the conditions for transfer between full arc and partial arc governor valve control modes can vary in other applications of the invention. For example, on a hot start, it may be desirable to transfer from throttle valve control directly to partial arc governor valve control at about 80% synchronous speed. A system for transferring between single valves or full arc operation and sequential valves or partial arc operation is disclosed in detail in U.S. Pat. No. 3,878,401, issued Apr. 15, 1975, which is incorporated herein by reference.

After the steam has crossed past the first stage impulse blading to the first stage reaction blading of the high pressure section 24, it is directed to a reheater system 30 which is associated in heat transfer relation with the steam generating system 22 as indicated by the reference character 32. With a raised enthalpy level, the steam flows from the reheater system 30 through the intermediate pressure turbine section 26 and the low pressure turbine section 28. From the latter, the vitiated steam is exhausted to a condenser 34 from which water flow is directed (not indicated) back to the steam generating system 26.

To control the flow of reheat steam, one or more reheat stop valves SV are normally open and close only when the turbine is tripped. Interceptor valves IV (only one indicated), are also provided in the reheat system flow path to control the flow of steam under certain circumstances. A throttle pressure detector 36 of conventional design senses the steam throttle pressure for data monitoring and/or turbine or plant control purposes. A conventional pressure detector 38 is employed to sense the first stage impulse pressure for assigned control usage in the turbine control system 11. A speed detection system 60 is provided for determining the turbine shaft speed for speed control and for frequency participation control purposes.

Respective hydraulically operated throttle valve actuators 40 and governor valve actuators 42 are provided for the four throttle valves TV1 through TV4 and the eight governor valves GV1 through GV8. Hydraulically operated actuators 44 and 46 are also provided for the reheat, stop and interceptor valves SV and IV. A high pressure hydraulic fluid supply 48 provides the controlling fluid for actuator operation of the valves TV1 through TV4, GV1 through GV8, SV and IV. The inlet valve actuators 40 and 42 are operated by respective electro-hydraulic position controls 48 and 50 which form a part of the control system 11. If desired, the interceptor valve actuators 46 can also be operated by a position control (not shown).

Figure 2:
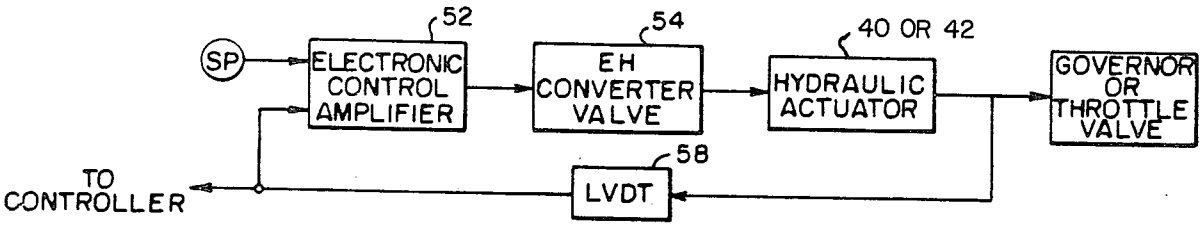
FIG. 2 is a schematic block diagram of a typical electro-hydraulic position control loop for operating the turbine governor and the throttle valves associated with the plant of FIG. 1.

Referring to FIG. 2, each position control includes the conventional electronic control amplifier 52 which drives a MOOG valve 54 or other suitable electrohydraulic (EH) converter valve in the well-known manner. Since the turbine power is proportional to steam flow under substantially constant throttle pressure, inlet valve positions are controlled to produce control over steam flow as an intermediate variable and over turbine speed and/or load as an end control variable or variables. The actuators position the steam valves in response to output position control signals applied through the EH converters 54. Respective valve position detectors PDT1 through PDT4 and PDG1 through PDG8 are provided (FIG. 1) to generate respective valve position feedback signals which are combined with respective valve position setpoint signals SP to provide position error signals from which the control amplifiers 52 generate the output control signals.

The setpoint signals SP are generated by a controller 56 (FIG. 1) which also forms a part of the control system 11. The position detectors are provided in suitable conventional form, for example, they may be linear variable differential transformers 58 which generate negative position feedback signals for algebraic summing with the valve position setpoint signals SP.

The combination of the amplifier 52, converter 54, hydraulic actuator 40 or 42, and the associated valve position detector 58 and other miscellaneous devices (not shown) form a local analog electro-hydraulic valve position control loop for each throttle or governor inlet steam valve. In the present embodiment, the local analog electro-hydraulic valve position control loop is included in the control system 11 where the controller 56 (FIG. 1) includes a program digital computer.

STEAM TURBINE CONTROL LOOPS

Figure 3:
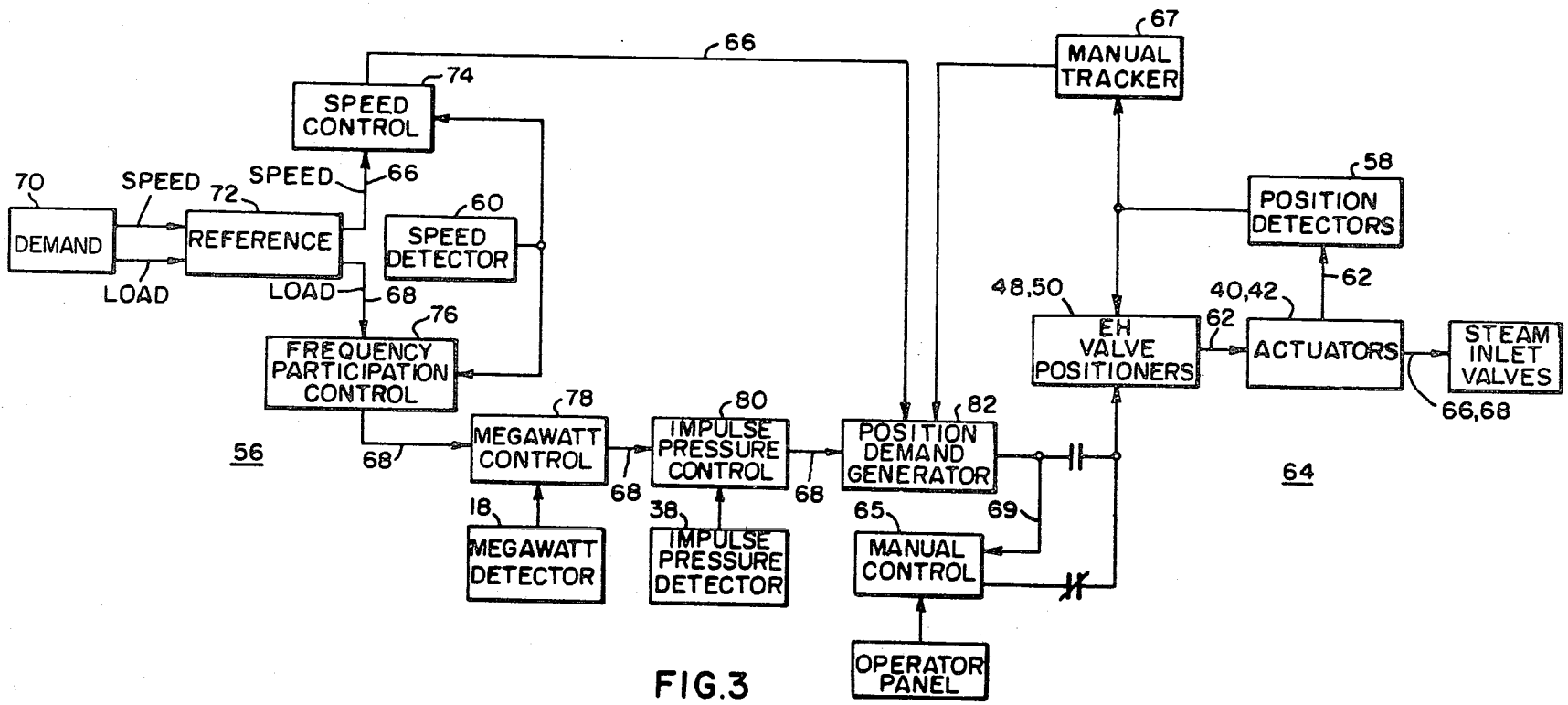
FIG. 3 is a schematic block diagram of control loop which represents the functioning of the control system of the plant of FIG. 1.

Referring to FIG. 3, a preferred arrangement of control loops generally referred to at 64 is employed in the control system 11 (FIG. 1) to provide automatic and manual turbine operation. A manual backup control 65 implements operator control actions during time periods when the automatic control is shut down. Relay contacts effect automatic or manual control operation as illustrated. A manual tracker 67 is employed for the purpose of updating the automatic control on the status of manual control 65 during manual control operation; and the manual control 65 is updated on the status of the automatic control during automatic control operation as indicated by the reference character 69 in order to provide for a bumpless transfer between the manual and automatic operating modes.

The control loop arrangement 64 may include an automatic speed control loop 66, which during start-up, operates the turbine inlet valves to place the turbine 10 under wide range speed control and bring it to synchronous speed for automatic or operator controlled synchronization. After synchronization, an automatic load control loop 68 operates the turbine inlet valves to load the turbine 10. The speed and load control loops 66 and 68 function through the previously noted EH valve position control loops 64. The controller 56 (FIG. 1) is included in the control loops, and includes a demand block 70. Speed and load demands are generated by the clock 70 for the speed and load control loops 64 and 66 under varying operating conditions in response to a remote automatic load dispatch unit, a synchronous speed requirement, a load or speed input generated by the turbine operator or other predetermined controlling inputs. A reference generator block 72 responds to the speed or load demand to generate a speed or load reference during turbine start-up and load operation preferably so that speed and loading change rates are limited to avoid excessive thermal stress from the turbine parts.

An automatic turbine start-up control can be included as part of the demand and reference blocks 70 and 72, and when so included it causes the turbine inlet steam flow to change to meet speed and/or load change requirements with rotor stress control. The speed control loop 66 preferably functions as a feedback type loop, and the speed reference is accordingly compared to a representation of the turbine speed derived from the speed detector 60 (FIG. 1). A speed control 74 responds to the resultant speed error to generate a steam flow demand from which a setpoint is developed for use in developing valve position demands for the EH valve position control loops 62 during speed control operation.

The load control loop 68 preferably includes a frequency participation control subloop, a megawatt control subloop and an impulse pressure control subloop which are all cascaded together to develop a steam flow demand from which a setpoint is derived for the EH valve position control loops 62 during load control operation. Preferably, the individual load control subloops are arranged so that they can be bumplessly switched into and out of operation in the load control loop 68.

In turn, an impulse pressure control 80 responds to an impulse pressure signal from the detector 38 and the impulse pressure demand from the megawatt control 78 to generate a steam flow demand from which the valve position demands are generated for feedforward application to the EH valve position control loops 62. Preferably, the impulse pressure control subloop is the feedback type with the impulse pressure error being applied to a proportional plus integral controller which generates the steam flow demand.

Generally, the application of feedforward and feedback principles in the control loops and the types of control transfer functions employed in the loops can vary from application to application. Reference is made to the copending application previously mentioned herein for a more detailed understanding thereof. Speed loop or load flow demand is applied to a position demand generator 82 which generates feedforward valve position demands for application to the EH valve position controls 52, 54 in the EH valve position control loop 62. Generally, the position demand generator 82 employs an appropriate characterization to generate throttle and governor valve position demands as required, for implementing the existing control mode as turbine speed and load requirements are satisfied. The position demand generator 82 also preferably includes a valve management function as set forth more fully in U.S. Pat. No. 3,878,401 previously referenced herein.

CONTROL SYSTEM

Figure 4:
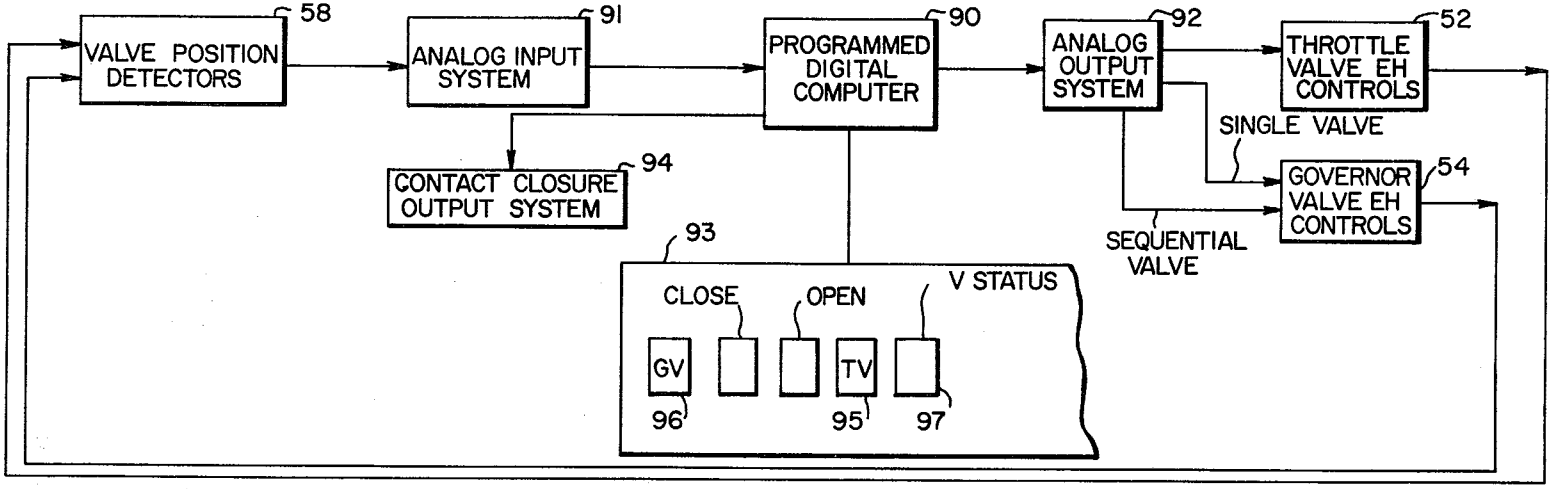
FIG. 4 is a schematic block diagram of a control system according to a preferred embodiment.

Referring to FIG. 4, the control system 11 (FIG. 1) includes a program digital computer 90 and associated input/output equipment. As shown in the block diagram of FIG. 4, each individual block generally corresponds to a particular structural unit of the control system 11. In relating FIG. 3 with FIG. 4, it is noted the particular functional blocks of FIG. 3 may be embraced by one or more structural blocks of FIG. 4. The computer 90 may be a W-2500 computer sold by Westinghouse Electric Corporation and designed for real time process control applications. Such a computer operates with a 16-bit word length, 2's complement, and single address in a parallel mode. A 3 microsecond memory cycle time is employed in the W-2500 computer; and all basic control functions can be performed with a 24K core. Expansion can be made to a 65K core to handle various options includable in particular control systems. A conventional analog input system 91 is coupled to the computer 90 to interface system analog signals, such as throttle and governor valve positions from a valve position detector 58 with the computer 90 at its input. Computer output signals are interfaced with external control devices through a suitable analog output system 92. An operator panel 93 provides for operator control, monitoring, etc., of the turbine generator system. Panel signals are applied to the computer 90 through a conventional contact closure input system (not shown) and computer display outputs are applied to the panel 93 through a contact closure output system 94. The analog output system 92 applies valve position signals to the throttle and governor valve controls 52 and 54 during automatic control. The valve position detectors 58, which may be linear variable differential transformers hereinbefore described, apply the valve positions to the analog input system 91. The panel 93 includes a valve status lamp 95 for the throttle valves and a valve status lamp such as 96 for the governor valves. Also, a lamp 97 is provided for the general overall valve status condition. As hereinafter described, in response to a contingency for any one of the throttle or governor valves, its associated lamp 95 and 96 in conjunction with lamp 97 will change there illumination aspect to inform the operator of a valve contingency.

It is understood, that the system of FIG. 4 is shown in simplified form and illustrating only those portions of the control system required for the structure of the valve contingency system of the present invention; and that such turbine control system includes other subsystems and components which are described in detail in the referenced U.S. Pat. No. 3,878,401 and the Giras et al. application referred to herein. For example, the system is assumed to include a conventional contact closure input system, a pulse input system, conventional interrupt system, manual backup control, and an overspeed protection controller. In addition to the valve position detectors, there is assumed to be a power or megawatt detector, an exhaust pressure detector, impulse chamber, vibration sensors, current and voltage sensors, and other miscellaneous detectors required for the proper operation of the system.

PROGRAM SYSTEM FOR CONTROL COMPUTER

Figure 5:
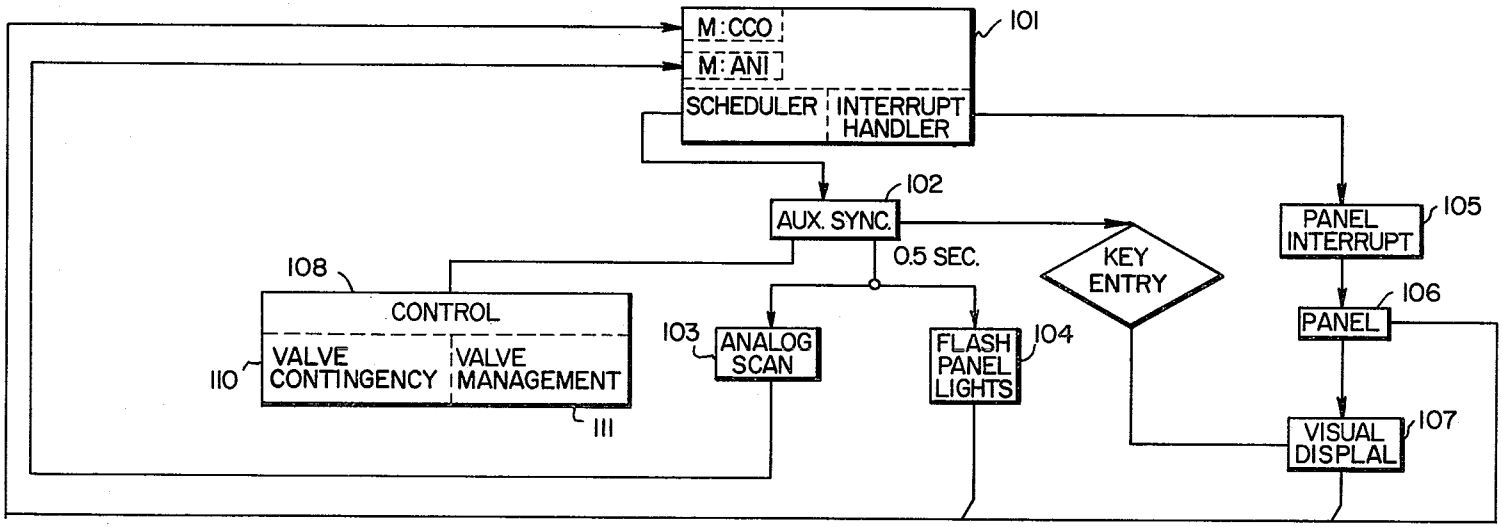
FIG. 5 is a schematic organization chart of a portion of the program system employed in the programmed digital computer of FIG. 4.

Referring to FIG. 5, a computer program system generally referred to at 100 is preferably organized to operate the control system 11 (FIG. 1) as a sampled data system in providing turbine and plant monitoring and continuous turbine and plant control with stability, accuracy, and substantially optimum response. The program system 100 is illustrated and will be described herein only to the extent necessary to develop an understanding of the manner in which the present invention is structured and applied. A program system similar to the program system 100 is disclosed in greater detail in the referenced Giras patent application Ser. No. 247,887.

A standard executive or monitor program 101 provides scheduling control over the running of programs in the computer 90 as well as control over the flow of computer inputs and outputs through the previously shown and described input/output systems. Generally, each program is assigned to a task level in a priority system, and bids are processed to run the bidding program with the highest priority. Interrupts may bid programs, and all interrupts are processed with a priority higher than any task level. Periodic programs are scheduled by an auxiliary synchronizer program 102, which in turn is bid each tenth of a second by the executive program 101. An external clock (not shown) functions as the system timing source. An analog scan program 103 is bid every half second to select analog inputs for updating through an executive analog input handler. After scanning, the analog scan program 103 converts the inputs to engineering units, performs limit checks, and makes certain logical decisions. A flash panel lights function 104 is also employed to flash predetermined panel lights such as the lamps 95 and 96 of FIG. 4, through the executive direct digital output handler under certain conditions. When an operator panel signal is generated, external circuitry decodes the panel input and an interrupt is generated to cause a panel interrupt program 105 to place a bid for the execution of a panel program 106, which provides a response to the panel request. The panel program 106 can itself carry out the necessary response or it can place a bid for a logic task program, not shown, to perform the response; or it can bid a visual display program 107 which operates contact closure outputs to produce the responsive panel display. Generally the visual display program 107 causes numerical data to be displayed in panel windows in accordance with operator request.

A control program 108 functions generally to compute throttle and governor valve positions to satisfy speed and/or load demand during operator or remote automatic operation; and carrying out the valve contingency function according to the present invention. Generally, the control program 108 is organized as a series of relatively short subprograms, such as a valve contingency program 110 and a valve management program 111 which are sequentially executed. The control program 108 also tracks valve position during manual operation.

In performing turbine control, speed data selection from multiple independent sources is utilized for operating reliability, and operator entered program limits are placed on high and low load, valve position and throttle pressure. Generally, the control program 108 executes operator or automatically initiated transfers bumplessly between manual and automatic modes, and bumplessly between one automatic mode and another automatic mode. In the execution of monitoring functions, the valve contingency subprogram 110 in accordance with the present invention is supplied with appropriate representations of data derived from the input detectors through the analog input system hereinbefore descibed. Also, the control program 108 is supplied with other representations of input data as required.

The control program 108 also logically determines turbine operating mode by a select operating mode function which operates in response to logic states detected by a logic program from panel and contact closure inputs. For each mode, appropriate values for demand and rate of change of demand are defined for use in control program execution of speed and/or load control. In executing turbine control within the control loops described in connection with FIG. 3, the control program 108 includes a speed/load reference function. Once the operating mode is defined, the speed/load reference function generates the reference which is used by the applicable control functions in generating valve position demand.

The speed or load reference is generated at a controlled or selected rate to meet the defined demand. Generation of the reference at a controlled rate until it reaches the demand is especially significant in the automatic modes of operation. In modes such as the automatic synchronizer, or automatic dispatch system, the reference is advanced in pulses which are carried out in single steps; and the speed/load reference function is essentially inactive in these modes. Generally, the speed/load reference function is responsive to GO and HOLD logic; and in the GO condition, the reference is run up or down at the program defined rate until it equals the demand or until a limit condition or synchronizer or dispatch requirement is met.

A speed control function provides for operating the throttle and governor valves to drive the turbine 10 to the speed corresponding to the reference with substantially optimum dynamic and steady state response. The speed error is applied to either a software proportional-plus-reset throttle valve controller or a software proportional-plus-reset governor valve controller. Similarly, a load control function provides for positioning the governor valves GV1 through GV8 so as to satisfy the existing load reference with substantially optimum dynamic and steady state response. The load reference value computed by the operating mode selection function is compensated for frequency participation by a proportional feedback trim factor and for megawatt error by a second feedback trim factor. A software proportional-plus-reset controller is employed in the megawatt feedback trim loop to reduce megawatt errors to zero.

The frequency and megawatt corrected load reference operates as a flow demand for the valve management subroutine 111 or as a setpoint for the impulse pressure control according to whether the impulse pressure control is in or out of service. The output of the impulse pressure controller or the output of the speed and megawatt corrected load reference functions as a governor valve setpoint which is converted into a percent flow demand prior to its application to the valve management subrouting 111.

The control program 108 further includes a throttle valve control function and a governor valve control function. During automatic control, the outputs from the throttle valve control function are position demands for the throttle valves, and during manual control the throttle valve control outputs are tracked to the like outputs from the manual control. Generally, the position demands hold the throttle valves closed during a turbine trip, provide for throttle valve position control during start-up and during transfer to governor valve control, and drive and hold the throttle valves wide open during and after the completion of the throttle/-governor valve transfer. The governor valve control function generally operates in a manner similar to that described for the throttle valve control function during automatic and manual operations of the control system 11. The governor valve control function outputs data applied to it by the valve management subroutine 111.

During automatic computer control, the valve management subrouting 111 develops the governor valve position demands needed to satisfy steam flow demand and ultimately the speed/load reference; and to do so in either the sequential or the single valve mode of governor valve operation, or during transfer between these modes. Mode transfer is affected bumplessly with no load change other than any which might be demanded during transfer. A detailed understanding of the valve management system including the transfer between sequential and single valve modes can be obtained from the referenced U.S. Pat. No. 3,878,401.

In the single valve mode, the calculated total governor valve position demand is divided by the total number of governor valves to generate the position demand per valve which is output as a single valve analog voltage (FIG. 4) applied commonly to all governor valves. In the sequential mode, the governor valve sequence is used in determining from the corrected position demand curve, which governor valve or group of governor valves is fully open; and which governor valve or group of governor valves is to be placed under position control to meet load reference changes. Position demands are determined for the individual governor valves, and individual sequential valve analog voltages (FIG. 4) are generated to correspond to the calculated valve position demands. The single valve voltage is held at zero during sequential valve operation, and the sequential valve voltage is held at zero during single valve operation.

To transfer from single to sequential valve operation, the net position demand signal applied to each governor valve EH control is held constant as the sequential valve analog voltage is stepped to zero, and the sequential valve analog voltage is stepped to the single valve voltage value. The steam flow changes required to reach target steam flows through individual governor valves are determined in accordance with previously calculated sequential valve position demands. Steam flow changes are then implemented iteratively, with the number of iterations determined by dividing the maximum flow change for any one governor valve by a predetermined maximum flow change per iteration. Total steam flow remains substantially constant during transfer since the sum of incremental steam flow changes is zero for any one iteration.

To transfer from sequential to single valve operation, such as in response to the detection of a valve contingency when operating in the sequential valve mode, the single valve position demand is determined from steam flow demand. Flow changes required to satisfy the target steam flow are determined for each governor valve; and an iteration procedure like that described for single to sequential transfer is employed in incrementing the valve positions to achieve the single valve target position substantially without disturbing total steam flow. If steam flow demand changes during any transfer, the transfer is suspended as the steam flow change is satisfied equally by all valves moving in the direction required to meet the changed. After new target flows are determined, the transfer then continues.

VALVE CONTINGENCY SYSTEM

Figure 6A:
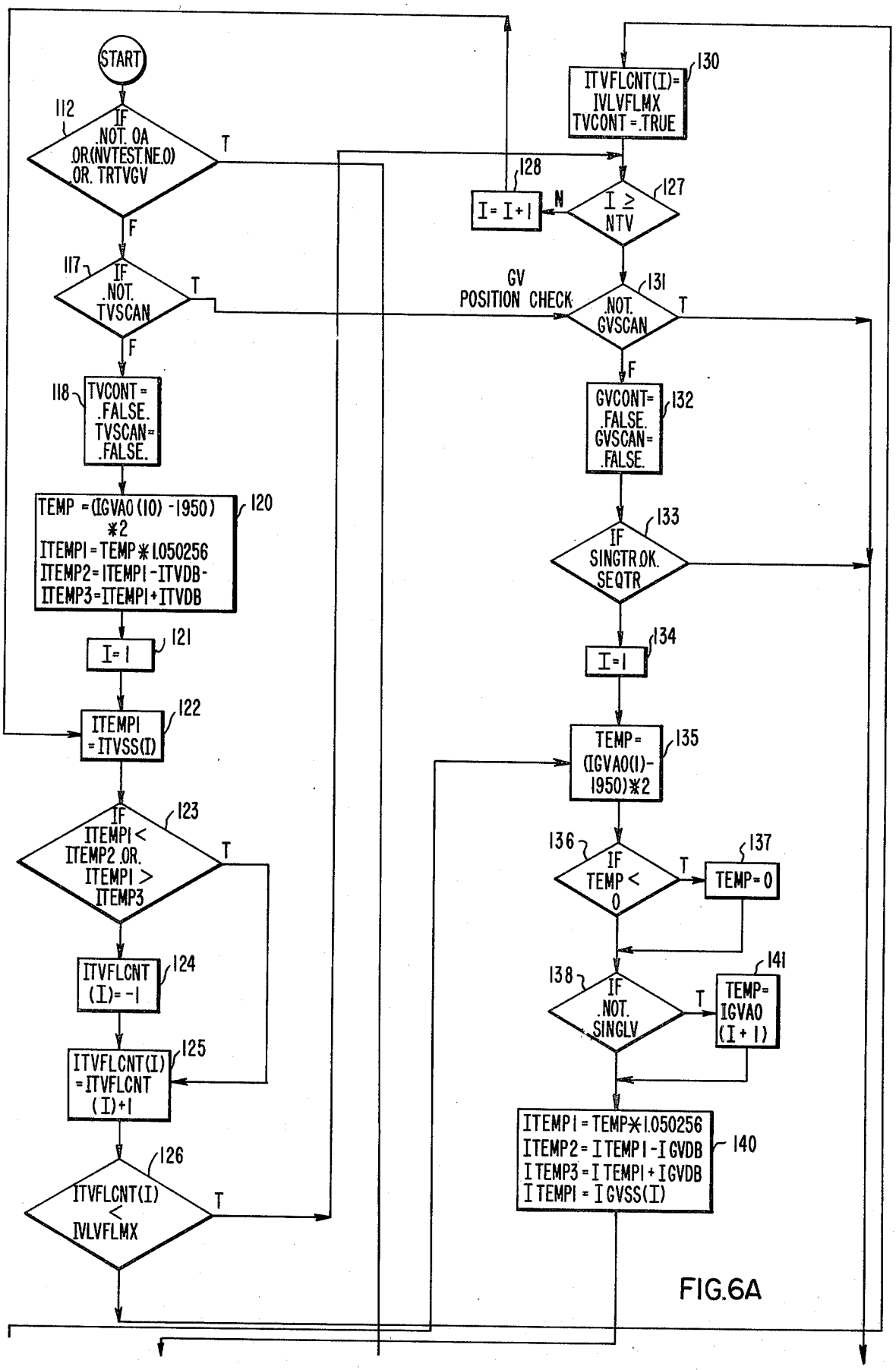
FIG. 6 is a flow chart of the valve contingency program according to one embodiment of the invention.
Figure 6B:
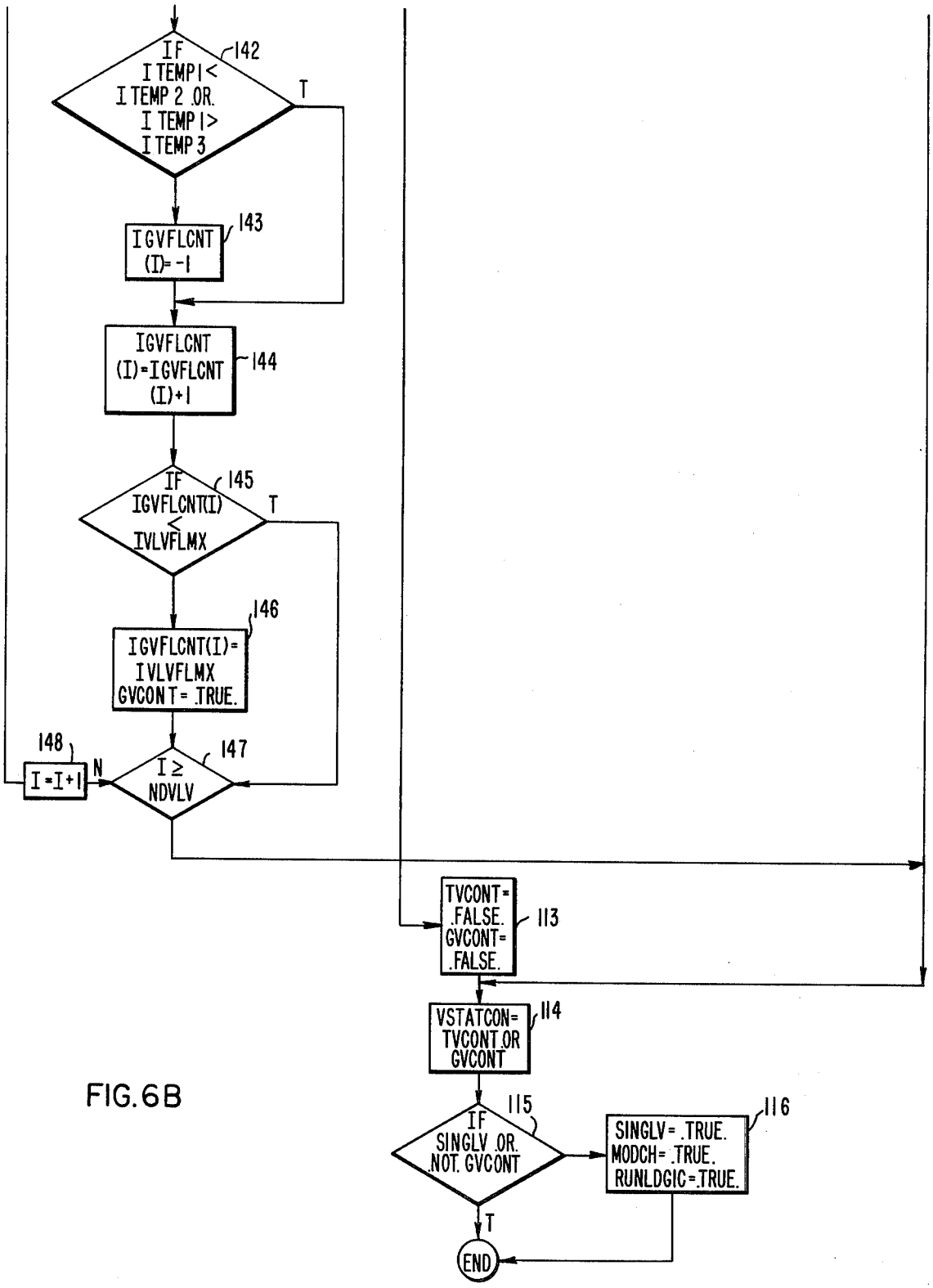

FIG. 6 illustrates schematically the valve contingency subprogram in flow chart form utilizing Fortran symbols as legends in the various decision and function blocks shown therein. Appendix A herein is an actual computer listing of the valve contingency system according to one embodiment of the invention. In describing the valve contingency system, reference will be made to the various function and decision blocks by numerial reference with the various Fortran symbols being defined accordingly therein.

Prior to discussing the operation of the program system, it should be noted that any time that a throttle valve contingency flag TVCONT or a governor valve contingency flag GVCONT is set to true, that the indicators on the panel for any particular throttle or governor valve indicate to the operator that a respective valve is not responding properly to its position demand signal. Further, that the analog scan function 103 (FIG. 4) is so constituted that the analog input system 91 (FIG. 4) transmits to the program digital computer 90 information as to the actual position of each of the valves as detected by its respective LVDT 58 every five seconds. However, the analog input scan for the throttle valves occur at a time period different than the analog input scan for the governor valve position. The valve contingency program is also run every five seconds as governed by the control program 108. It is understood, that the frequency of operation of the throttle valve contingency program and the detection of the analog inputs by the analog scan program may differ for various applications and installations as will become evident from the description herein.

The system first checks at block 112 the operational state of the digital electro-hydraulic turbine system. If the system is not in operator automatic (OA) or happens to be conducting a valve test (NVTEST), or in the process of transferring from throttle valve to governor valve (TRTVGV), the throttle valve contingency flag (TVCONT) and the governor valve contingency flag (GVCONT) are set to false at block 113. The valve status contingency flag (VSTATCON) is set equal to the throttle valve contingency or governor valve contingency flags at block 114. If the system is in single valve operation (SINGLV) or there is no governor valve contingency as determined at block 115, the program ends until the next 5 second period begins. If the block 115 determines that there is a governor valve contingency and the system is not in single valve operation, the single valve operation flag, the mode change operation flag (MODCH), and the program for running the logic program (RUNLOGIC) flags are all set to be true at block 116; and the program exits. The function and decision blocks 113, 114, 115, and 116 are further described in connection with other operative situations where their function will become more apparent.

Assuming that the block 112 determines that the system is in operator automatic, it next checks at block 117 to determine if the analog scan program 103 (FIG. 5) for the throttle valves (TVSCAN) is set indicating that the positions for all of such valves have been input to the computer subsequent to the last running of the valve contingency program. If the throttle valve scan flags have not been set, the contingency program then transfers to check the governor valve portion thereof which will be described hereinafter.

Assuming that the throttle valve positions from the analog input system 91 have been read by the analog scan program, then the valve contingency program sets the throttle valve contingency flags (TVCONT) to be false and the throttle valve scan flag (TVSCAN) false which in effect, removes any indication of a throttle valve contingency that may have been indicated during the last running of the program, and also prepares the program to read on the next subsequent reading the valve positions from the analog input system.

After the throttle valve contingency and throttle valve scan flags have been set to false, the program calculates the digital throttle valve position demand in the form of a bit pattern at function block 120. The bit pattern for the throttle valves is designated as IGVAO(10). The normal range of analog control for a valve is from 0 to 10 volts, which is represented by a digital signal for the throttle valve from 0 to 3900. However, the actual throttle valve analog control signal that is effective in operating the valve varies from 5 to 10 volts. Thus, there would be no control of the throttle valves between the digital representation of 0 and a bit value of 1950. So in order to prevent a contingency signal for the throttle valve below a 1950 bit value, such bit value is subtracted from the throttle valve position demand signal IGVAO(10). This places the value at a 0 bit value when the signal that keeps the valve barely closed is actually a 1950 bit value. This difference is then multiplied by 2 to provide the proper scale for the valve contingency program. For example, in calculating the throttle valve analog output bit pattern TEMP, assume that the valve is approximately 50% open in response to a digital signal having a bit pattern of 2925 corresponding to an analog voltage of 7½ volts. On a scale of 0 to 10 volts, this would ordinarily indicate that the valve is 75% open. Therefore, the bit value 1950 as shown in block 120 is subtracted from the digital bit value 2925 leaving a value of 975. This value is then multiplied by 2 resulting in a calculation for TEMP of 1950, which, provides the proper scaling for a valve that is 50% open. Because the normal digital scale for an analog output in the present embodiment of the invention corresponding to 10 volts is a bit pattern of 4096, the value TEMP, which in the present example is 1950, is multiplied by a factor 1.050256, which is the ratio of 4096 to 3900 and provides the resultant digital value ITEMP1. This value is the temporary variable corresponding to the bit pattern for the throttle valve position demand signal IGVAO(10), which in the present example is a bit pattern of 2048 rounded off to the nearest integer, or approximately a 50% digital value which corresponds to the proper scale of 4096 for a value of 10 volts.

The value ITEMP2 in block 120 represents the lower end of a predetermined deadband ITVDB, which for example, may be a digital value of 50, is subtracted from the variable ITEMP1, or in the present example, a digital bit value of 1998 approximately. The value ITEMP3 represents the upper end of the deadband ITVDB; and by adding a digital value of 50, for example, the result is a bit value of 2098. Thus there if provided in the present example, a deadband which extends from a bit value of 1998 to a bit value of 2098, which represents a total tolerance of approximately 1¼ percent on each side of the position demand bit value ITEMP1.

After the deadbands for the throttle valve position demand signal have been calculated, the block 121 resets the program for interrogating the actual position of the throttle valves beginning with throttle valve TV1, for example. The actual position of the throttle valve TV1 as input to the computer 90 by the analog input program is then substituted for the variable ITEMP1 at block 122. The analog to digital conversion of the actual position referred to as ITVSS(I) was properly scaled by the analog input program.

Then, at decision block 123, the actual position of the throttle valve is compared with the lower deadband ITEMP2 and the upper deadband ITEMP1. Assuming that the actual position of the value which is now the temporary variable ITEMP1 is below the upper deadband and above the lower deadband, a counter for the first throttle valve ITVFLCNT(1) is set equal to −1 at function block 124. The counter ITVFLCNT(1) for the throttle valve TV1 is then incremented by one at function block 125 with the result that the counter is set to 0 each time that the program determines that the actual position of the valve is within the deadbands for the valve position demand signal. Assuming that the actual position of the throttle valve TV1 is outside of the deadbands as determined at 123, then the counter is added to at 125 without a previous subtraction at 124 as previously described. Then the actual count of the counter ITVFLCNT(1) is compared with a maximum count IVLVFLMX at block 126.

If the block 126 indicates that the count for the throttle valve TV1, for example, is less than the maximum count, then the system indicates that the throttle valve position does not warrant a contingency indication because the maximum time has not yet expired for the operation of the LVDT58 to catch up to the position demand signal.

The program then checks at block 127 to determine if the value I is equal to or less than the total number of throttle valves. If 127 indicates that all of the throttle valves have been checked, the program then begins checking the governor valves. However, if all of the throttle valves have not been checked during this running of the program, the value I is increased by 1 at block 128 and the actual position of the next throttle valve ITVSS(2) becomes the temporary variable ITEMP1. The program then proceeds through the blocks 123 through 126 as previously described for the throttle valve TV2. This continues, until all of the throttle valves have been checked. In the event that the block 126 determines that the count for the throttle valve being checked is not less than the maximum count IVLVFLMX, then such counter is made equal to the maximum count at block 130 and the TV contingency flag TVCONT is set true which provides a valve contingency indication for such throttle valves on the operator's panel 93 (FIG. 4).

To summarize the actual detection of a valve contingency, each time the program is run, each one of the throttle valves is checked against the position demand signal to determine if it is within the proper tolerance of response. If it is, its counter is set to a 0 condition by way of the function blocks 124 and 125. If it is not, each time the program is run, the counter for a respective valve is increased by 1 until it reaches the maximum count as determined at block 126. Thus, if the valve position should be outside of the deadband for less than the maximum count, no contingency is detected. The amount of time for the throttle valves may be adjusted by varying the constant IVLVFLMX.

After the throttle valves have been checked, the governor valve scan flag is checked at 131 to determine if the governor valve positions have been read by the analog input subsequent to the last running of the valve contingency program. If has been read, the governor valve contingency flag GVCONT and the governor valve scan flag GVSCAN are both set to falso at 132. The system then determines at 133 whether or not a single to sequential transfer SINGTR or SEQTR is in progress. If a valve transfer is not in progress, the system is reset to begin interrogating the governor valves in sequence by setting I equal to 1 at 134. The system then calculates the variable TEMP to correspond to the bit pattern for the valves in the single valve mode of operation at 135 for the valve GV1. This bit pattern IGVAO(1) is calculated in the same manner as described in connection with the calculation of the variable TEMP for the throttle valves. As previously mentioned, when the system is in sequential valve operation, the single valve bit pattern is 1950 and when the system is in single valve operation, the bit pattern for each of the valves corresponding to the sequential position demand is 0. Thus, if TEMP is less than 0, as determined at 136, the variable TEMP is set to 0 at 137. Then, if the system is determined to be in single valve operation at 138, the deadband calculations are made at block 140 in the same manner as the calculations were made for the throttle valves at block 120. However, if the system is determined to be in sequential valve operation, as determined at 138, the variable TEMP is made equal to the position demand for the sequential mode for the governor valve being interrogated at 141. Subsequent to the calculations in block 140, the variable ITEMP1, which represents the position demand signal for the valve being interrogated, is compared at 142 with the upper and lower deadbands ITEMP2 and ITEMP1 in the same manner as block 123 for the throttle valve contingency. If the actual position of the valve IGVSS(I), as also calculated at 140, is within the deadband, then the counter for the governor valve being interrogated IGVFLCNT(I) is set to −1 at 143. The counter is then incremented by 1 at 144 so that it now equals 0 count. The count is compared with a maximum count at 145 in the same manner as the throttle valve comparison at 126; and if the count is not less than the maximum count, as determined at 146, the valve contingency flag GVCONT is set to be equal to true. Each one of the valves in turn is interrogated by checking at 147 and then incrementing the number by 1 at block 148. The program then repeats itself from the block 135 through the block 147 until all of the governor valves have been checked. In the same manner as the throttle valves, in the event that a valve should be determined to be outside the deadband at 142, the counter IGVFLCNT is increased by 1 until it equals the maximum count for setting the contingency true at the block 146. After the governor valves have been checked, the valve status contingency flag VSTATCON is set to be equal to the TV contingency or the GV contingency flag at the block 114. If either one of those are determined to be true, which indicates that one of the valves is not responding properly in the time period designated, then the block 115 determines whether or not the system is in sequential mode. If the system is in sequential mode, then the flag's single valve SINGLV is set true and the flag mode change MODCH is set true, which transfers the system via the valve management program 111 as set forth in detail in the U.S. Pat. No. 3,878,401. The details of transferring between sequential and single valve operation form no part of the present invention.

In summary, each time the contingency program is run, a counter for each of the valves is either set to 0 or incremented by 1. After a respective valve counter has reached a maximum count, depending on the particular installation, or depending on the frequency with which the program is run, the contingency flag is set for that particular valve provided the valve position has been detected to be outside of its deadband of valve position demand for the required time.

Although, the invention has been described in connection with a digital computer control of the steam turbine system, it is understood, that instead of a programmed digital computer that the system could include a microprocessor or a combination of a microprocessor and programmed digital computer in accordance with the teachings of the present invention.

We claim:

1. A steam turbine system, comprising a plurality of steam inlet valves for governing the admission of steam to the turbine, means to generate an electrical representation of a desired valve position for each of the steam inlet valves, means to control each of the steam inlet valves in accordance with the desired valve position representation, means to generate an electrical representation of actual valve position for each of the steam inlet valves, means when activated to generate a contingency output representation for each of the steam inlet valves, means to compare the representations of actual and desired position for each of the steam inlet valves, means governed by the compared representation to initiate a predetermined time duration for each valve at times when the actual and desired representations of a respective valve differ by a predetermined value, means governed by the comparison means to activate the contingency output generating means in response to a compared difference of said predetermined value at the termination of the initiated time duration period for each valve, and means governed by the activated contingency generating output means for each valve to indicate a contingency for such associated valve.

2. A system according to claim 1 wherein the means to generate the representation of desired valve position includes means to transfer the position of each of the steam inlet valves between single valve and sequential valve operating modes, and means responsive to the actuation of the contingency output generating means for any one of the steam inlet valves when operating in the sequential valve mode to operate the transfer means to change the position of the valves to the single valve mode.

3. A system according to claim 1 wherein the comparison means includes means to generate a first representation in excess of the generated desired valve position representation in accordance with the generated representation of desired valve position, means to generate a second representation less than the generated desired valve position representation in accordance with the generated representation of desired valve position, and means to compare the actual valve position representation with the first and second generated representations.

4. A system according to claim 3 wherein the means to initiate a predetermined time interval includes a counting means operative to be set to zero in response to an actual position representation value between the value of the first and second generated representations, and means to increase the counting means in response to the actual position representation above and below the first and second generated representations respectively, and said contingency activating means being responsive to a predetermined count of the counting means in excess of zero.

5. A steam turbine system, comprising a plurality of steam inlet valves to control the flow of steam to the turbine;

means to control the desired position of each of the valves in accordance with an electrical signal;

means to generate an electrical analog signal corresponding to the actual position of each valve;

a contingency indicator for each of the valves effective when activated to indicate the failure of an associated valve to respond to its respective positioning signal;

means to convert a generated digital representation of desired valve position to govern the value of the analog signal for controlling desired position of each valve;

means to convert the analog signal of actual valve position to a corresponding digital representation;

calculating means including sequencing means having the following components, a. means to generate for each valve the digital representation of desired valve position, b. means to compare repetitively at predetermined time intervals, the value of the digital representation of desired valve position with the digital representation of actual valve position for each of the plurality valves, c. a counting means governed by the comparison means to count in one direction at each said time interval at times when the compared representations differ by a predetermined value and to reset in the other direction at each said interval at times when the compared representatives differ less than a predetermined value, d. a contingency output generating means operative when activated to detect a failure of a respective valve to respond to its desired position representation, e. means governed by the counting means to activate the output generating means at each predetermined interval at times when the counting means is operated to a predetermined count in the one direction; and means responsive to the activated detection means to indicate the failure of a respective valve.

6. A system according to claim 5 wherein the calculating means includes a means to deactivate the activated detecting means at each predetermined interval.

7. A system according to claim 5 wherein the calculating means is structured in a programmed digital computer.

8. A system according to claim 5 wherein the comparing means comprises means to generate a first digital representation in excess of the desired position representation, means to generate a second digital representation less than the desired position representation, and means to compare the digital representation of actual position with said first and second digital representations.

9. A system according to claim 8 wherein the calculating means is structured in a programmed digital computer.

10. A system according to claim 5 wherein the calculating means further includes transfer means to vary the digital representation for each valve means to change the valve operating from sequential to single mode; and means responsive to the activated contingency output generating means to operate the transfer means at times when the valves are in the sequential mode.

11. A system according to claim 10 wherein the calculating means is structured in a programmed digital computer.

* * * * *